US006851777B2

(12) United States Patent
Speckhart

(10) Patent No.: US 6,851,777 B2
(45) Date of Patent: Feb. 8, 2005

(54) METHOD AND APPARATUS FOR SENSING AND MAINTAINING A GAP BETWEEN AN INK JET PRINTHEAD AND A PRINT MEDIUM

(75) Inventor: Frank H. Speckhart, Knoxville, TN (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/328,900

(22) Filed: Dec. 24, 2002

(65) Prior Publication Data

US 2004/0119764 A1 Jun. 24, 2004

(51) Int. Cl.[7] ..... B41J 25/308
(52) U.S. Cl. ..... 347/8
(58) Field of Search ..... 347/8; 400/55–60, 400/120.17

(56) References Cited

U.S. PATENT DOCUMENTS 6,557,987 B1 * 5/2003 Shibata et al. ..... 347/84

FOREIGN PATENT DOCUMENTS

JP 40513712 * 5/1993

OTHER PUBLICATIONS

Schwarz, O. and Grafstein, P., Pictorial Handbook of technical Devices, Chemical Publishing Co., 1971, p. 542–43.*

Merriam –Webster Dictionary [online], [retrieved Dec. 17, 2003] from http://www.m–w.com/cgi–bin/dictionary.*

* cited by examiner

*Primary Examiner*—Michael S. Brooke
(74) *Attorney, Agent, or Firm*—Taylor & Aust, P.C.

(57) ABSTRACT

An apparatus positions an ink jet printhead relative to a print medium onto which the printhead jets ink. A conduit is attached to the printhead and has an opening disposed in opposition to the print medium. An air-moving device moves air through the conduit. A pressure-sensing device senses pressure within the conduit. A gap-adjusting assembly moves the printhead and/or the print medium dependent upon the pressure sensed by the pressure-sensing device.

25 Claims, 3 Drawing Sheets

METHOD AND APPARATUS FOR SENSING AND MAINTAINING A GAP BETWEEN AN INK JET PRINTHEAD AND A PRINT MEDIUM

BACKGROUND OF THE INVENTION

1. Field of the Invention

The present invention relates to an ink jet printer, and, more particularly, to setting a gap between a printhead and a print medium, i.e., a printhead gap, in an ink jet printer.

2. Description of the Related Art

It is generally known that improvements in ink jet printing can be achieved if the printhead can be positioned closer to the paper and if this gap distance between the printhead and the paper can be controlled within desired limits. An ink jet printhead moves or scans across the width of a sheet of paper, depositing ink drops onto the paper as the printhead scans. The printhead is generally slidingly coupled to a guide rod or shaft, which is oriented parallel to the direction of movement of the printhead. The printhead is coupled tightly enough to the guide rod that the straightness of the guide rod largely determines the straightness of the path of the printhead. Thus, the straightness of the guide rod partly determines the variations in the gap between the printhead and the paper, hereinafter referred to as the "printhead gap", as the printhead scans. The straightness or flatness of the platen that supports the paper in opposition to the printhead also partly determines the variations in the printhead gap.

It is known to very precisely manufacture the guide rod with a high degree of straightness in order to limit variations in the printhead gap. It is also known to manufacture the platen very precisely with a high degree of straightness or flatness. Further, it is known to support the platen with one or more very precisely manufactured shafts having a high degree of straightness in order to provide the paper-engaging surface of the platen with a desired degree of straightness or flatness. A problem is that such precisely manufactured guide rods, platens and shafts are very expensive.

What is needed in the art is a method of dynamically adjusting the printhead gap while printing, thereby eliminating the need for expensive, precisely manufactured guide rods, platens and shafts.

SUMMARY OF THE INVENTION

The present invention provides a method and apparatus for sensing the size of a printhead gap and dynamically adjusting the printhead gap to a desired size.

The invention comprises, in one form thereof, a method of operating an ink jet printer. A printhead is positioned to jet ink onto a print medium. A conduit is attached to the printhead. The conduit has an opening opposing the print medium. Air is caused to flow through the conduit. A pressure within the conduit is measured. A printhead gap between the printhead and the print medium is adjusted dependent upon the measuring step.

The invention comprises, in another form thereof, an apparatus that positions an ink jet printhead relative to a print medium onto which the printhead jets ink. A conduit is attached to the printhead and has an opening disposed in opposition to the print medium. An air-moving device moves air through the conduit. A pressure-sensing device senses pressure within the conduit. A gap-adjusting assembly moves the printhead and/or the print medium dependent upon the pressure sensed by the pressure-sensing device.

The invention comprises, in yet another form thereof, an ink jet printer for printing on a print medium. A conduit is attached to an ink jet printhead. The conduit has an opening disposed in opposition to the print medium. An air-moving device moves air through the conduit. A pressure-sensing device senses pressure within the conduit. A gap-adjusting assembly moves the printhead and/or the print medium dependent upon the pressure sensed by the pressure-sensing device.

An advantage of the present invention is that expensive, high precision guide rods, platens and shafts are not needed.

Another advantage is that the apparatus of the present invention does not touch or contact the print medium.

Yet another advantage is that the printhead can be positioned closer to the platen and dynamic gap adjustments can be made to accommodate print mediums of different thicknesses, such as envelopes.

A further advantage is that air flowing through the nozzle and onto the paper facilitates drying of the ink.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
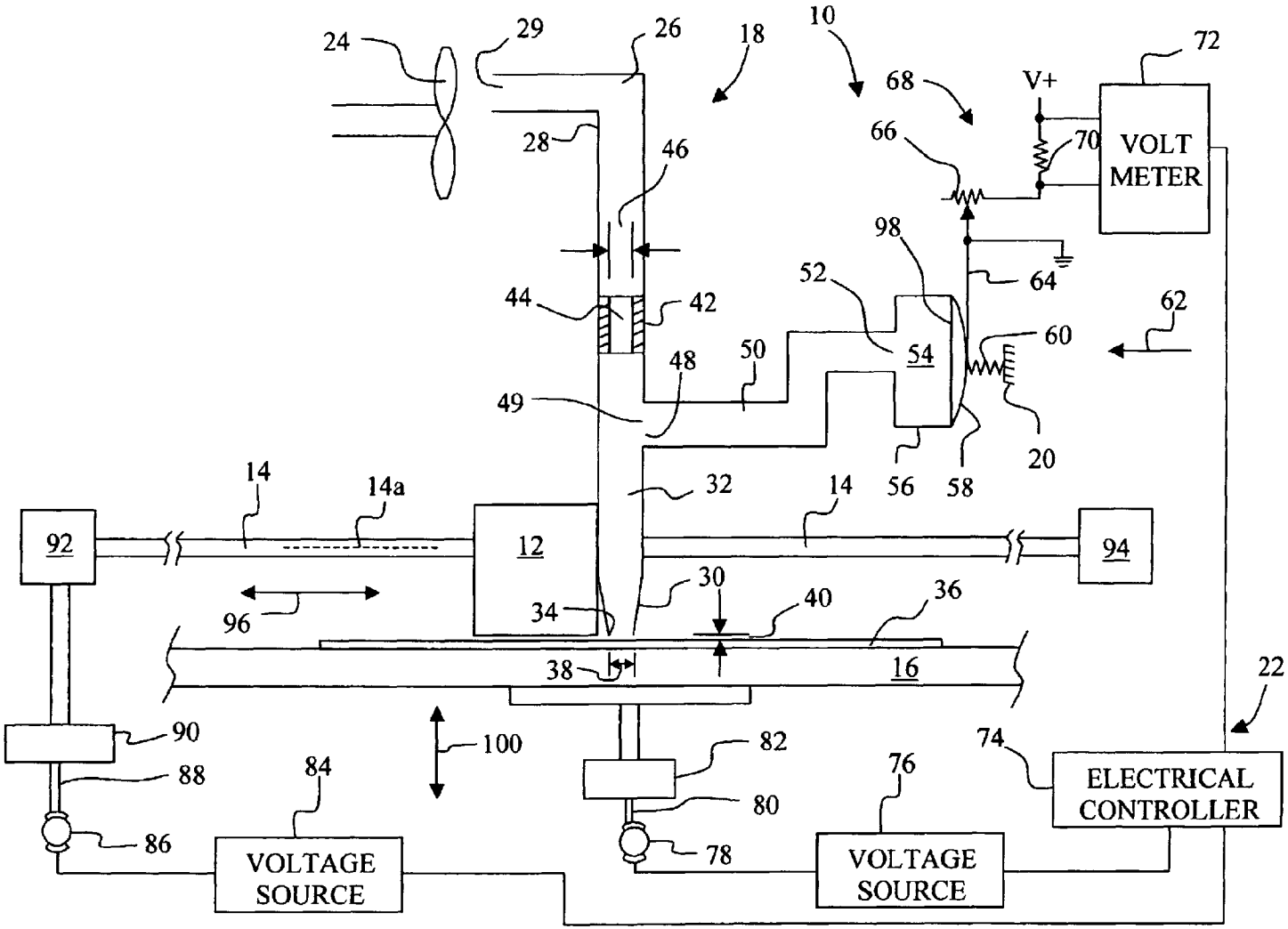
FIG. 1 is a schematic view of one embodiment of a printer of the present invention.

Referring now to the drawings, and particularly to FIG. 1, there is shown one embodiment of a printer 10 of the present invention, including a printhead 12, a guide rod 14, a platen 16, a gap-sensing assembly 18, a fixed structure 20, and a gap-adjusting assembly 22.

Ink jet printhead 12 is slidingly coupled to guide rod 14. The axis 14*a* of guide rod 14 defines a bi-directional scanning path for printhead 12. Guide rod 14 is oriented parallel to a width of platen 16.

Gap-sensing assembly 18 includes an air pressure source, or air-moving device, 24. Air-moving device 24 can be, for example, a small cooling fan which supplies positive air pressure to an upper section 26 of a first flexible conduit or tube 28 through an opening 29. Tube 28 is attached to printhead 12. The air pressure in upper section 26 is approximately the static pressure of fan 24 and can be approximately 0.1 inches of water. A very small fraction of the air from fan 24 is supplied to a nozzle 30 in a lower section 32 of first tube 28. Nozzle 30 tapers to an opening at an end 34.

Figure 2:
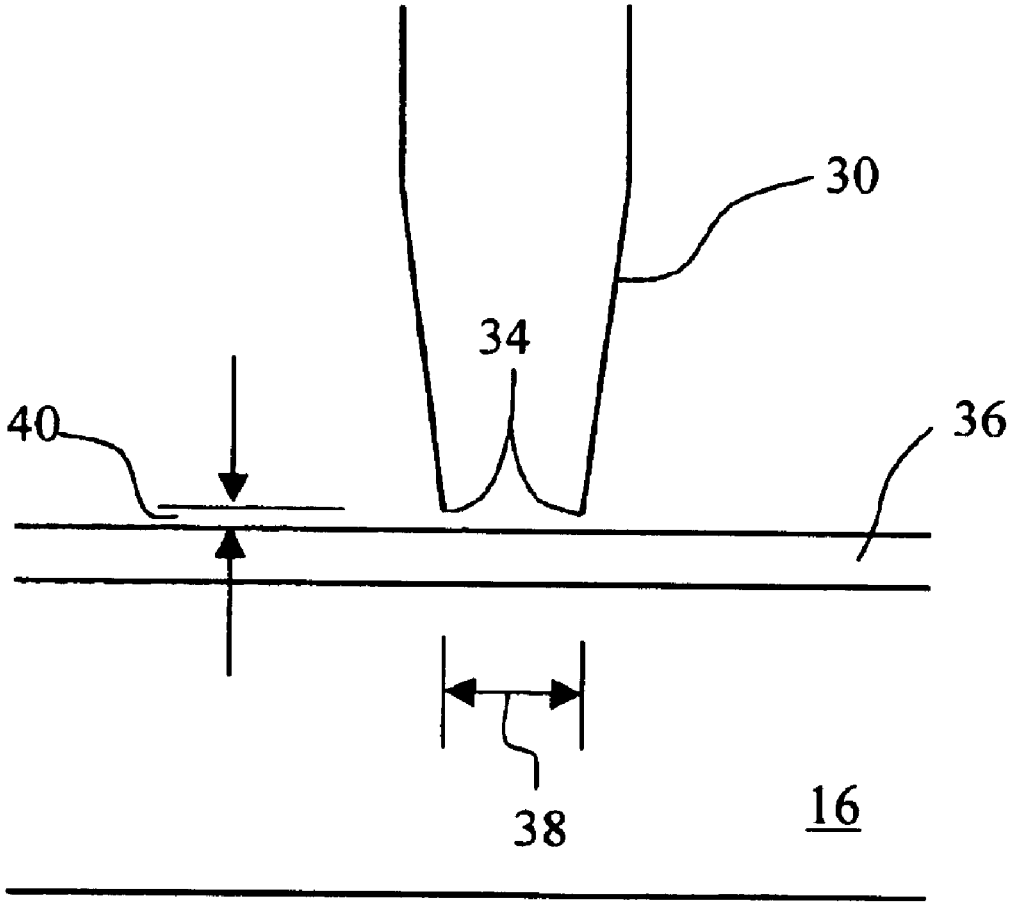
FIG. 2 is an enlarged, schematic view of the nozzle, paper and platen of FIG. 1.

The opening at end 34 of nozzle 30 is disposed closely adjacent and in opposition to a sheet of print medium, such as paper 36 supported on platen 16. The opening is also oriented parallel to paper 36. End 34 is disposed approximately 0.7 millimeter from paper 36 and is also disposed closely adjacent to printhead 12. End 34 as well as the remainder of first tube 28 has a circular cross section. A width or diameter 38 (FIG. 2) of end 34 is approximately four times greater than a maximum height of a gap 40 between nozzle 30 and paper 36. That is, gap 40 is less than 25% of width 38.

A cylindrical fluid resistor 42 is disposed in first tube 28 and separates, interconnects and defines upper section 26 and lower section 32. Fluid resistor 42 has a channel 44 fluidly connecting upper section 26 and lower section 32. Channel 44 has a circular cross section and a diameter 46 approximately equal to diameter 38 of nozzle end 34. Fluid resistor 42 constricts the flow of air from upper section 26 to lower section 32, thereby causing the air pressure in upper section 26 to be greater than that in lower section 32.

The resistance of fluid resistor 42, i.e., the size of diameter 46, is chosen to maximize the change in backpressure within lower section 32 for a given change in gap 40. Thus, the sensitivity of gap-sensing assembly 18 is maximized.

Lower section 32 includes an opening 49 in fluid communication with and fluidly connected to a first end 48 of a second conduit in the form of a flexible tube 50. A second end 52 of tube 50 is fluidly connected to a cavity 54 of a housing 56 of a pressure-sensing device. The pressure-sensing device is attached to tube 50. An extremely flexible, circular diaphragm 58 forms a side of housing 56 opposite from end 52 of tube 50.

A compression spring 60 is attached to fixed structure 20 and engages diaphragm 58. Spring 60 biases diaphragm 58 in the direction indicated by arrow 62.

A grounded electrical contact 64 is attached to diaphragm 58. Contact 64 is a part of a potentiometer 66 which, in turn, is part of a voltage divider 68. Voltage divider 68 also includes a resistor 70.

A voltmeter 72 is connected across resistor 70. As the last sequential element of gap-sensing assembly 18, an output of voltmeter 72 is connected to gap-adjusting assembly 22.

Gap-adjusting assembly 22 includes electrical controller 74, voltage sources 76, 84, motors 78, 86, actuators 82, 90 and guide rod holders 92, 94. An output of voltmeter 72 is connected to an input of electrical controller 74, which can include, for example, a microprocessor and associated memory that executes control instructions. A first output of controller 74 is connected to an input of a first voltage source 76. An output of voltage source 76 is connected to a first motor 78. An output shaft 80 of motor 78 is mechanically coupled to a first actuator 82 which is attached to platen 16.

A second output of controller 74 is connected to an input of a second voltage source 84. An output of voltage source 84 is connected to a second motor 86. An output shaft 88 of motor 86 is mechanically coupled to a second actuator 90 which is attached to a movable guide rod holder 92. Another movable guide rod holder 94 is attached to guide rod holder 92 such that holder 94 follows the movement of holder 92. Holders 92 and 94 are attached to respective opposite ends of guide rod 14. Actuators 82 and 90 are the last sequential elements of gap-adjusting assembly 18.

Figure 3:
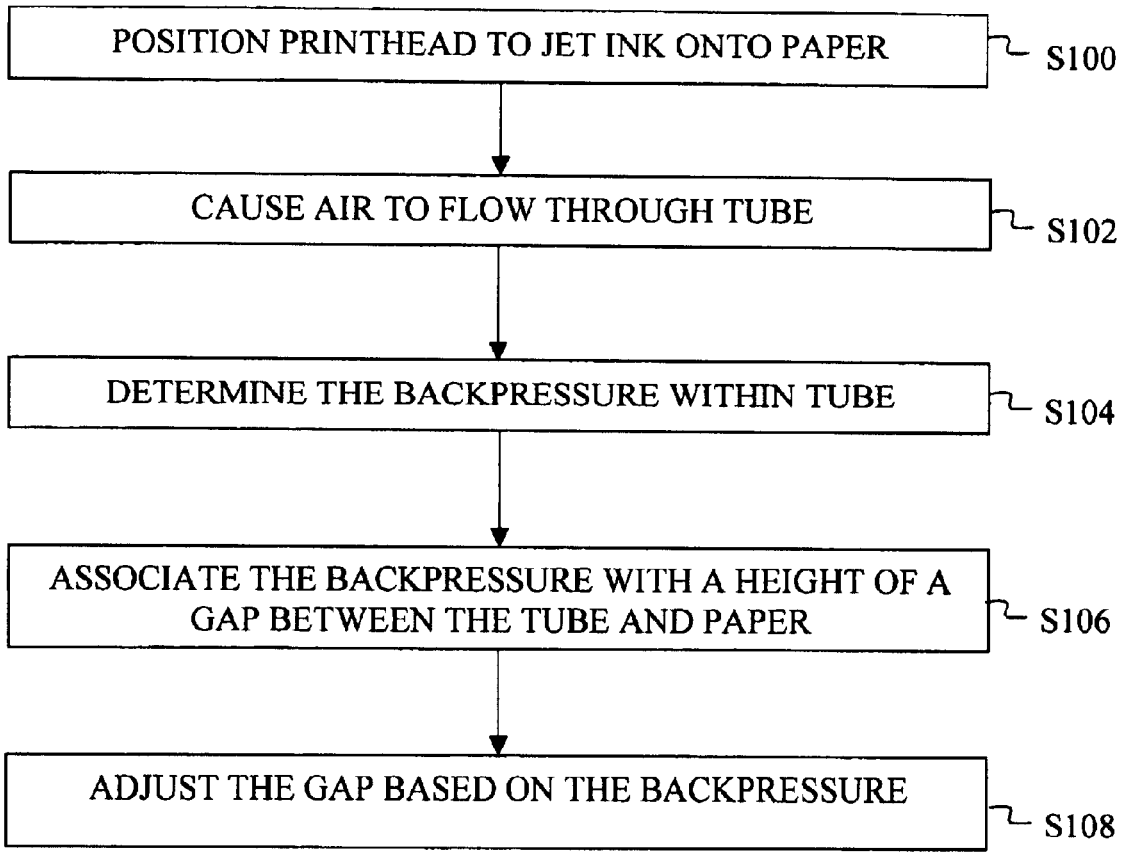
FIG. 3 is a flow chart of one embodiment of the method of the present invention.

Referring now to FIG. 3, during use, at step S100, printhead 12 is positioned to jet ink onto paper 36. Since nozzle 30 is attached to printhead 12, nozzle 30 moves with printhead 12 both laterally, i.e., in the directions indicated by double arrow 96, and into and out of the page of FIGS. 1 and 2.

At step S102, air is caused to flow through upper section 26. More particularly, fan 24 blows air into opening 29, which is in direct communication with fan 24 to receive air therefrom. Air flows through nozzle 30 and then radially outward in the area between end 34 of nozzle 30 and paper 36. The height of gap 40 between end 34 of nozzle 30 and paper 36 determines the rate of airflow through first tube 28. The airflow through nozzle 30 may assist in drying the ink that has been immediately previously jetted onto paper 36 by printhead 12, regardless of the direction of scan of printhead 12.

At step S104, the backpressure within nozzle 30 is determined. As gap 40 between nozzle 30 and paper 36 changes due to, for example, variations in paper thickness, straightness of guide rod 14, straightness of platen 16, etc., the flow area for the air between end 34 of nozzle 30 and paper 36 also changes. Because of this change in the flow area, the mass flow rate of air through nozzle 30 and the backpressure within nozzle 30 changes. The backpressure acts on diaphragm 58. When cavity 54 is at atmospheric pressure, diaphragm 58 is planar and is disposed in zero position 98. When the backpressure acts upon diaphragm 58, diaphragm 58 is forced outward against the action of spring 60, as shown in FIG. 1. The smaller gap 40 is, the greater is the backpressure, and the greater is the outward deflection of diaphragm 58. Thus, the axial position of diaphragm 58 is a function of the gap 40 between the nozzle opening and paper 36. The volume of cavity 54 and the fluid resistance of second tube 50 can control the time response of the movement of diaphragm 58.

At step S106, the backpressure is associated with a height of gap 40. The axial position of diaphragm 58 is measured by the combination of voltage divider 68 and voltmeter 72. As diaphragm 58 moves in the direction opposite to direction 62, contact 64 also moves in the same direction, thereby reducing the resistance of potentiometer 66. As the resistance of potentiometer 66 decreases, the voltage across resistor 70, as measured by voltmeter 72, increases. Thus, the backpressure with tube 28 is measured, and the output of voltmeter 72 is indicative of the size of gap 40. This actual size of gap 40 is compared with a desired, or target, size of gap 40.

At step S108, if the actual size of gap 40 is not equal to a desired size of gap 40, then gap 40 is adjusted based on the measured backpressure. Controller 74 receives the voltage output of voltmeter 72 and activates voltage source 76 and/or voltage source 84 accordingly. Upon activation, voltage source 76 powers motor 78, which drives actuator 82 to raise or lower platen 16 in one of the directions of double arrow 100. By moving platen 16 up or down, gap 40 is decreased or increased, respectively. Likewise, upon activation, voltage source 84 powers motor 86, which drives actuator 90 to raise or lower guide rod holders 92, 94 in one of the directions of double arrow 100. By moving guide rod holders 92, 94 up or down, and hence guide rod 14 and printhead 12 up or down, gap 40 is increased or decreased, respectively. Thus, gap 40 is adjusted to the desired size.

Both platen 16 and guide rod 14 can be moved to adjust gap 40. It is also possible to move only platen 16 or to move only guide rod 14 to adjust gap 40. Both adjustments can be made with the same gap-adjusting assembly 22.

By the method described above, using gap-sensing assembly 18 and gap-adjusting assembly 22, feedback control is used to maintain a constant, desired gap 40 as printhead 12 scans in directions 96. Since nozzle 30 is attached to printhead 12, and the relationship between gap 40 and the gap between printhead 12 and paper 36 is known, a constant, desired gap between printhead 12 and paper 36 is also maintained by feedback control as printhead 12 scans in directions 96. The steps of causing air to flow within tube 28, measuring pressure within tube 28, and adjusting the gap between printhead 12 and paper 36 are preformed continuously during the scanning of printhead 12.

It is alternatively possible to detect and/or measure the axial position of diaphragm 58 by use of several different devices, including contact points, capacitance-measuring devices, electro-optics, etc. These sensors/detectors can be used with elements of common feedback-control to control an electrical/mechanical device such as a motor to dynamically change the paper-print head gap to be within the desired range. Various feedback and control techniques can be used, such as on-off, proportional, microprocessor controlled, etc.

It is also possible for an inexpensive pressure transducer to replace the flexible diaphragm. The diaphragm or control switch (pressure sensors) can be located physically close to the print head, and can also move with the print head. The diaphragm or pressure sensor could be an integral part of the nozzle assembly. For instance, the diaphragm or pressure sensor could be an integral part of first tube 28.

The magnitude of the fluid resistance of fluid resistor 42 can be adjusted to obtain optimum performance. Although fluid resistor 42 is shown in FIG. 1 as being a discrete element, it is also possible for the fluid resistor to be formed integrally with first tube 28. For example, the diameter and length of upper section 26 could be chosen to provide a desired level of fluid resistance.

Channel 44 of fluid resistor 42 has been shown herein as having a diameter approximately equal to diameter 38 of nozzle end 34. However, it is also possible for the diameter of the channel of the fluid resistor to be different than diameter 38 of nozzle end 34.

An external spring 60 is shown in FIG. 1. However, it is also possible for the flexibility of the diaphragm to serve as the spring-like element.

The gap between printhead 12 and paper 36 is shown in FIG. 1 to be equal to gap 40 between nozzle end 34 and paper 36. However, it is also possible for the gap between printhead 12 and paper 36 to be greater than or less than gap 40.

Platen 16 is shown as being a planar object. However, it is also possible for the platen to be a roller having an axis parallel to the scanning direction of the printhead.

The present invention has been described as keeping the gap between printhead 12 and paper 36 constant as printhead scans in directions 84. However, it is to be understood that the present invention can also be used to keep the gap between printhead 12 and paper 36 constant as printhead 12 moves in any other direction.

The present invention has been described as blowing air downwardly through tube 28 and measuring a positive pressure in housing 56. However, it is also possible for fan 24 to suck air upwardly through tube 28 and measure a negative pressure in housing 56.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of operating an ink jet printer, comprising the steps of positioning a printhead to jet ink onto a print medium;

attaching a conduit to said printhead, said conduit having a first opening opposing the print medium, and said conduit having a second opening;

causing air to flow through said conduit by blowing air through said opening;

measuring a pressure within said conduit;

providing a fluid resistor in said conduit, said fluid resistor interconnecting a first section of said conduit including said first opening and a second section of said conduit including said second opening, said first section containing a backpressure, said second section containing a static pressure; and adjusting a printhead gap between said printhead and the print medium dependent upon said measuring step.

2. The method of claim 1, comprising the further step of scanning said printhead across the print medium, said causing measuring and adjusting steps being performed substantially continuously during said scanning.

3. The method of claim 2, wherein said adjusting step comprises maintaining a height of the printhead gap constant substantially throughout said scanning step.

4. The method of claim 1, wherein said measuring step comprises measuring said backpressure within said first section of said conduit.

5. The method of claim 1, wherein said first opening of said conduit has a width, said method comprising the further step of positioning said conduit such that a gap between said first opening and the print medium is less than 25% of said width of said first opening.

6. An apparatus for positioning an ink jet printhead relative to a print medium onto which said printhead jets ink, said apparatus comprising:

a first conduit configured to be attached to the printhead, said first conduit having a first opening configured to be disposed in opposition to the print medium, said first conduit having a second opening and a third opening;

a second conduit fluidly connected to said third opening;

an air-moving device configured to move air through said first conduit, said air-moving, device being in direct communication with said second opening;

a pressure-sensing device attached to said second conduit, said pressure sensing device being configured to sense pressure within said first conduit;

a gap-adjusting assembly configured to move at least one of the printhead and the print medium dependent upon the pressure sensed by said pressure-sensing device; and a fluid resistor disposed between said second opening and said third opening, wherein said fluid resistor interconnects a first section of said first conduit including said first opening and a second section of said first conduit including said second opening, said first section containing a backpressure, said second section containing a static pressure.

7. The apparatus of claim 6, wherein said first opening of said conduit is configured to be disposed within 2 millimeters of the print medium.

8. The apparatus of claim 6, wherein said first opening of said first conduit has a width, a gap between said first opening and the print medium being configured to be less than 25% of said width of said first opening.

9. The apparatus of claim 6, wherein said second opening of said first conduit is configured to receive air from said air moving device.

10. The apparatus of claim 6, wherein said pressure-sensing device includes a housing fluidly connected to said second conduit, said housing having a side comprising a flexible diaphragm.

11. The apparatus of claim 10, wherein a deflection of said diaphragm is dependent upon a gap between said first opening of said first conduit and the print medium.

12. The apparatus of claim 6, wherein said first conduit comprises a first flexible tube, said second conduit comprising a second flexible tube.

13. The apparatus of claim 6, wherein said first conduit includes a nozzle tapering to said first opening.

14. The apparatus of claim 6, wherein said first opening of said first conduit is configured for being oriented substantially parallel to the print medium.

15. The apparatus of claim 6, wherein said first opening of said first conduit is adjacent to the printhead.

16. An ink jet printer for printing on a print medium, comprising:

an ink jet printhead;

a first conduit configured to be attached to said printhead, said first conduit having a first opening configured to be disposed in opposition to the print medium, said first conduit-having a second opening and a third opening;

a second conduit fluidly connected to said third opening;

an air-moving device configured to move air through said first conduit, said second opening being in direct communication with said air-moving device;

a pressure-sensing device configured to sense pressure within said first conduit, said pressure-sensing device being attached to said second conduit; and a gap-adjusting assembly configured to move at least one of said printhead and the print medium dependent upon the pressure sensed by said pressure-sensing device; and a fluid resistor disposed between said second opening and said third opening, wherein said fluid resistor interconnects a first section of said first conduit including said first opening and a second section of said first conduit including said second opening, said first section containing a backpressure, said second section containing a static pressure.

17. The printer of claim 16, wherein said first opening of said first conduit is configured to be disposed within 2 millimeters of the print medium.

18. The printer of claim 16, wherein said first opening of said first conduit has a width a gap between said first opening and the print medium being configured to be less than 25% of said width of said first opening.

19. The printer of claim 16, wherein said second opening of said first conduit is configured to receive air from said air-moving device.

20. The printer of claim 16, wherein said pressure-sensing device includes a housing fluidly connected to said second conduit, said housing having a side comprising a flexible diaphragm.

21. The printer of claim 20, wherein a deflection of said diaphragm is dependent upon a gap between said first opening of said first conduit of said first conduit and the print medium.

22. The printer of claim 16, wherein said first conduit comprises a first flexible tube, said second conduit comprising a second flexible tube.

23. The printer of claim 16, wherein said first conduit includes a nozzle tapering to said first opening.

24. The printer of claim 16, wherein said first opening of said first conduit is configured for being oriented substantially parallel to the print medium.

25. The printer of claim 16, wherein said first opening of said first conduit is adjacent to said printhead.

* * * * *